US006089696A

United States Patent [19]

Lubinsky

[11] Patent Number: 6,089,696

[45] Date of Patent: Jul. 18, 2000

[54] INK JET PRINTER CAPABLE OF INCREASING SPATIAL RESOLUTION OF A PLURALITY OF MARKS TO BE PRINTED THEREBY AND METHOD OF ASSEMBLING THE PRINTER

[75] Inventor: Anthony R. Lubinsky, Penfield, N.Y.

[73] Assignee: Eastman Kodak Company, Rochester, N.Y.

[21] Appl. No.: 09/188,574

[22] Filed: Nov. 9, 1998

[51] Int. Cl.[7] ..... B41J 2/145; B41J 2/15; B41J 29/393; B41J 23/00

[52] U.S. Cl. ..... 347/40; 347/37; 347/19

[58] Field of Search ..... 347/37, 41, 12, 347/19, 40

[56] References Cited

U.S. PATENT DOCUMENTS

| | | | |
|---|---|---|---|
| 4,063,254 | 12/1977 | Fox et al. | 347/41 |
| 4,069,486 | 1/1978 | Fox | 347/41 |
| 4,401,991 | 8/1983 | Martin | 347/41 |
| 4,593,295 | 6/1986 | Matsufuji et al. | 347/41 |
| 4,675,696 | 6/1987 | Suzuki | 347/43 |
| 4,774,529 | 9/1988 | Paranjpe et al. | 347/43 |
| 5,488,397 | 1/1996 | Nguyen et al. | 400/82 |
| 5,598,192 | 1/1997 | Burger et al. | 347/43 |
| 5,771,050 | 6/1998 | Gielen | 347/19 |
| 5,870,117 | 2/1999 | Moore | 347/37 |

*Primary Examiner*—N. Le
*Assistant Examiner*—Thinh Nguyen
*Attorney, Agent, or Firm*—Walter S. Stevens

[57] ABSTRACT

An ink jet printer capable of increasing spatial resolution of a plurality of marks to be printed thereby and method of assembling the printer. The printer comprises a print head body having a nozzle block including a plurality of adjacent ink channels of predetermined pitch "P" for printing an image on a receiver. The nozzle block is slidably disposed in the print head body and thus is movable relative to the print head body. A displacement mechanism is connected to the nozzle block for slidably moving the nozzle block a predetermined distance "$P_1$" less than pitch P. Before the nozzle block is moved, the channels are enabled in order to eject ink droplets which have pitch P for defining a first spatial resolution of the marks on the receiver. The displacement mechanism then moves the nozzle block the predetermined distance $P_1$ to a second position. The channels are again enabled while the nozzle block is in this second position. Additional marks are then formed intermediate the marks formed when the nozzle block was in its first position. All the marks formed on the receiver now define a second spatial resolution greater than the first spatial resolution of the marks, so that the image has increased spatial resolution.

6 Claims, 13 Drawing Sheets

INK JET PRINTER CAPABLE OF INCREASING SPATIAL RESOLUTION OF A PLURALITY OF MARKS TO BE PRINTED THEREBY AND METHOD OF ASSEMBLING THE PRINTER

BACKGROUND OF THE INVENTION

This invention generally relates to printer apparatus and methods and more particularly relates to an ink jet printer capable of increasing spatial resolution of a plurality of marks to be printed thereby and method of assembling the printer.

An ink jet printer produces images on a receiver by ejecting ink droplets onto the receiver in an imagewise fashion. The advantages of non-impact, low-noise, low energy use, and low cost operation in addition to the capability of the printer to print on plain paper are largely responsible for the wide acceptance of ink jet printers in the marketplace.

In one type of ink jet printer, ink is disposed in a plurality of ink chambers formed in a print head. An orifice in communication with the chamber opens onto a receiver medium which receives ink droplets ejected from the orifice. The means of ejection may, for example, be a piezoelectric crystal coupled to the chamber and deformable when subjected to an electric pulse. When the crystal deforms, a pressure wave is produced in the ink in the chamber, which pressure wave ejects one or more ink droplets through the orifice. Other types of ink jet printers include heaters for lowering surface tension of an ink meniscus residing in the orifice, so that an ink droplet is released from the orifice when the surface tension is sufficiently lowered.

Moreover, in ink jet printing it is common to use a technique referred to as "interlace printing" in order to increase printed resolution. With regard to interlace printing, a print head having a plurality of printing elements is swept in a reciprocating motion across a receiver. After one or more such reciprocating passes, the print head is then moved in uniform increments of distance with respect to the receiver in a direction perpendicular to the reciprocating motion in order to achieve the afore-mentioned interlaced printing.

Such an interlace ink jet printer is disclosed in U.S. Pat. No. 4,069,486 titled "Single Array Ink Jet printer" issued Jan. 17, 1978, in the name of S. J. Fox. This patent teaches printing an interlace pattern with a single array of ink jet nozzles. According to this patent, number of individual print elements N, print element spacing p, printed pel spacing D, and printhead-receiver displacement distance delta-x must bear a predetermined relationship to each other, in order for interlaced printing to occur, without doubly printed lines or spaces. Namely, if the print element spacing p is equal to kD, then the displacement delta-x must be chosen equal to ND. Furthermore, k must be an integer chosen such that, when k is divided by N, the result is an irreducible fraction. Thus, there is a required relationship between N, D and delta-x.

Multiple resolution ink jet printers are known. A multiple resolution ink jet printer is disclosed in U.S. Pat. No. 4,401,991 titled "Variable Resolution, Single Array, Interlace Ink Jet Printer" issued Aug. 30, 1983, in the name of Van C. Martin. This patent discloses a multiple-resolution, interlace, ink jet printer that uses a single array with multiple nozzles of constant pitch. In one embodiment of the Martin device, the single array achieves multiple-resolution printing by disabling some of the nozzles while adjusting translation motion of the array, so that dot rows can be printed closer together in order to increase spatial resolution. In this manner, the fixed pitch of the nozzles is not an impediment to increasing spatial resolution of the image to be printed. Thus, the Martin technique represents an improvement over the Fox technique in that pel spacings D can be varied using the Martin technique. However, it appears the Martin technique of increasing spatial resolution is not cost-effective because, at least in one embodiment of the Martin device, some of the nozzles are initially disabled and therefore do not print. Manufacture of unused nozzles increases material and fabrication costs of the printer and is thus wasteful. It would therefore be desirable to provide a printing device and technique that increases spatial resolution while using all available nozzles.

A disadvantage of the prior art techniques recited hereinabove is that the relative displacement of the printhead and the receiver must be precise, and that the relative motion be large enough to cover the length of the print. If the motion is not precise, then the interlaced sets of lines may be improperly spaced, leading to unwanted density variations in the printed image. Unwanted density variations can be camouflaged by multiple passes of the printhead. However, multiple passes of the printhead increases printing time. It is difficult to inexpensively and precisely translate the printhead over the required distance; thus, typically the receiver or paper is translated relative to the printhead. However, this results in the need for two translation systems in the printer, one for the printhead and one for the paper, which adds to manufacturing costs.

A further disadvantage of the prior art recited hereinabove is that the relative displacement of the printhead and the receiver should be accurate, and that this relative motion be large enough to cover the length of the print. If the motion is not accurate, then it may not be possible to provide controllable minimal displacements delta-x small enough to achieve high-resolution, high-quality printing.

Consequently, in order to avoid the disadvantages recited hereinabove, it is desirable to provide an ink jet printing technique wherein there is no required relationship between N, D, and delta-x; wherein the printhead-receiver motion may be other than uniform; wherein required relative motions between printhead and receiver may be provided with increased precision and accuracy over the required range; and wherein one of the two motion translation systems required of the prior art is unnecessary.

Therefore, there is a need to provide a suitable ink jet printer capable of increasing spatial resolution of a plurality of marks to be printed thereby and method of assembling the printer.

SUMMARY OF THE INVENTION

An object of the present invention is to provide an ink jet printer capable of increasing spatial resolution of a plurality of marks to be printed thereby and method of assembling the printer.

With the above object in view, the invention resides in an ink jet printer capable of increasing spatial resolution of a plurality of marks to be printed thereby, comprising a print head body; and a first printing element and a second printing element coupled to said print head body and movable in unison relative thereto for printing the marks, said first and second printing elements movable from a first printing position defining a first spatial resolution of the marks to a second printing position defining a second spatial resolution of the marks greater than the first spatial resolution.

According to an exemplary embodiment of the invention, an ink jet printer comprises a print head body having a nozzle block slidably disposed therein for printing an image on a receiver having width "W". Thus, the nozzle block is movable relative to the print head body. Moreover, the print head body itself is movable in reciprocating fashion across width W by means of a suitable transport mechanism. The nozzle block includes a plurality of side-by-side ink channels of predetermined pitch "P". Each channel is adapted to eject ink droplets onto the receiver to sequentially form each line of the image while the print head reciprocates across width W. A displacement mechanism is connected to the nozzle block for slidably moving the nozzle block in the print head body. That is, the displacement mechanism moves the nozzle block relative to the print head body. In this regard, the displacement mechanism is adapted to move the nozzle block a predetermined distance "$P_1$" less than pitch P. However, before the nozzle block is moved, the channels are enabled in order to eject ink droplets which, of course, have pitch P. In this initial position of the nozzle block, the marks formed on the receiver define a first spatial resolution of the marks. The displacement mechanism is then caused to slidably move the nozzle block in the print head body the predetermined distance $P_1$. The nozzle block, and thus the channels, are now in a second position relative to the print head body. At this second position, the channels are again enabled. When the channels are enabled the second time, additional marks are formed intermediate the marks formed when the nozzle block was in its first position. All the marks now formed on the receiver define a second spatial resolution greater than the first spatial resolution of the marks. In this manner, spatial resolution of the image is increased due to increased spatial resolution of the marks comprising the image.

A feature of the present invention is the provision of a nozzle block slidably movable in a print head body that traverses a receiver for printing an image on the receiver.

Another feature of the present invention is the provision of a displacement mechanism for slidably moving the nozzle block relative to the print head body.

An advantage of the present invention is that the image to be printed obtains increased spatial resolution.

Another advantage of the present invention is that fault tolerance of the printer is increased.

Still another advantage of the present invention is that spatial resolution of the image is increased in a cost-effective manner.

These and other objects, features and advantages of the present invention will become apparent to those skilled in the art upon a reading of the following detailed description when taken in conjunction with the drawings wherein there are shown and described illustrative embodiments of the invention.

BRIEF DESCRIPTION OF THE DRAWINGS

While the specification concludes with claims particularly pointing-out and distinctly claiming the subject matter of the present invention, it is believed the invention will be better understood from the following detailed description when taken in conjunction with the accompanying drawings wherein:

DETAILED DESCRIPTION OF THE INVENTION

The present description will be directed in particular to elements forming part of, or cooperating more directly with, apparatus in accordance with the present invention. It is to be understood that elements not specifically shown or described may take various forms well known to those skilled in the art.

Figure 1:
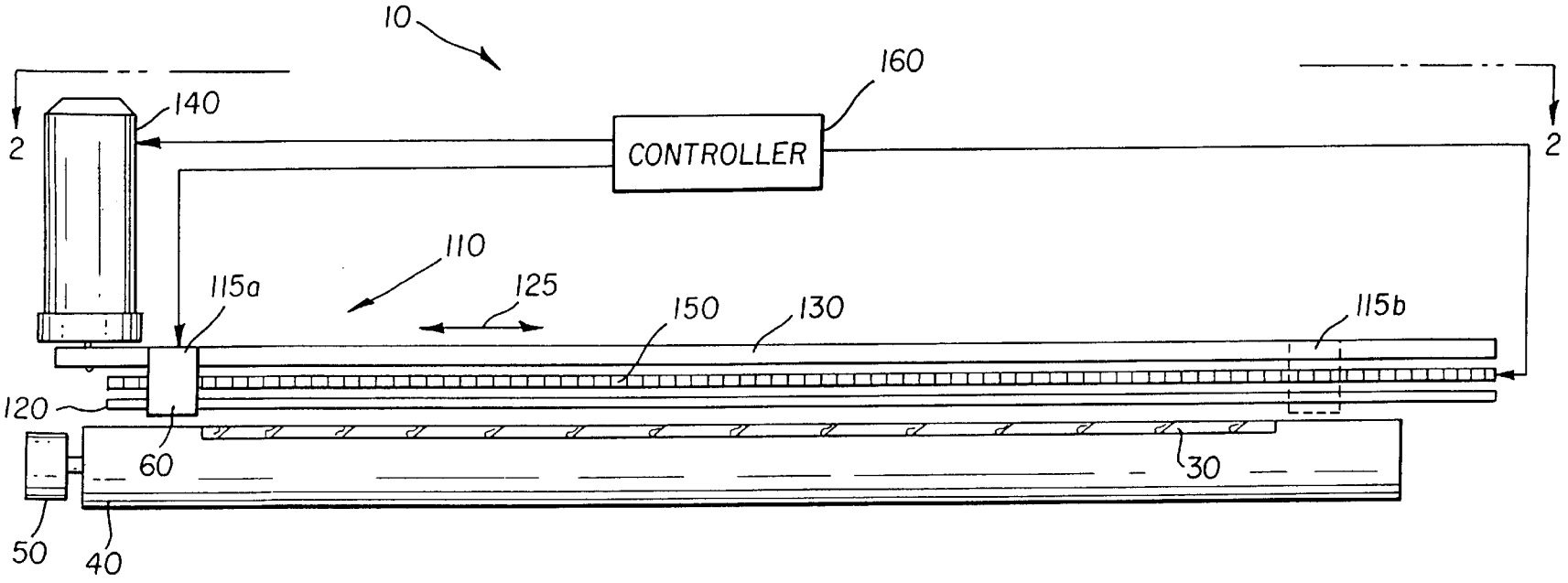
FIG. 1 is a view in elevation of a first ink jet printer belonging to the present invention for printing an image on a receiver.
Figure 2:
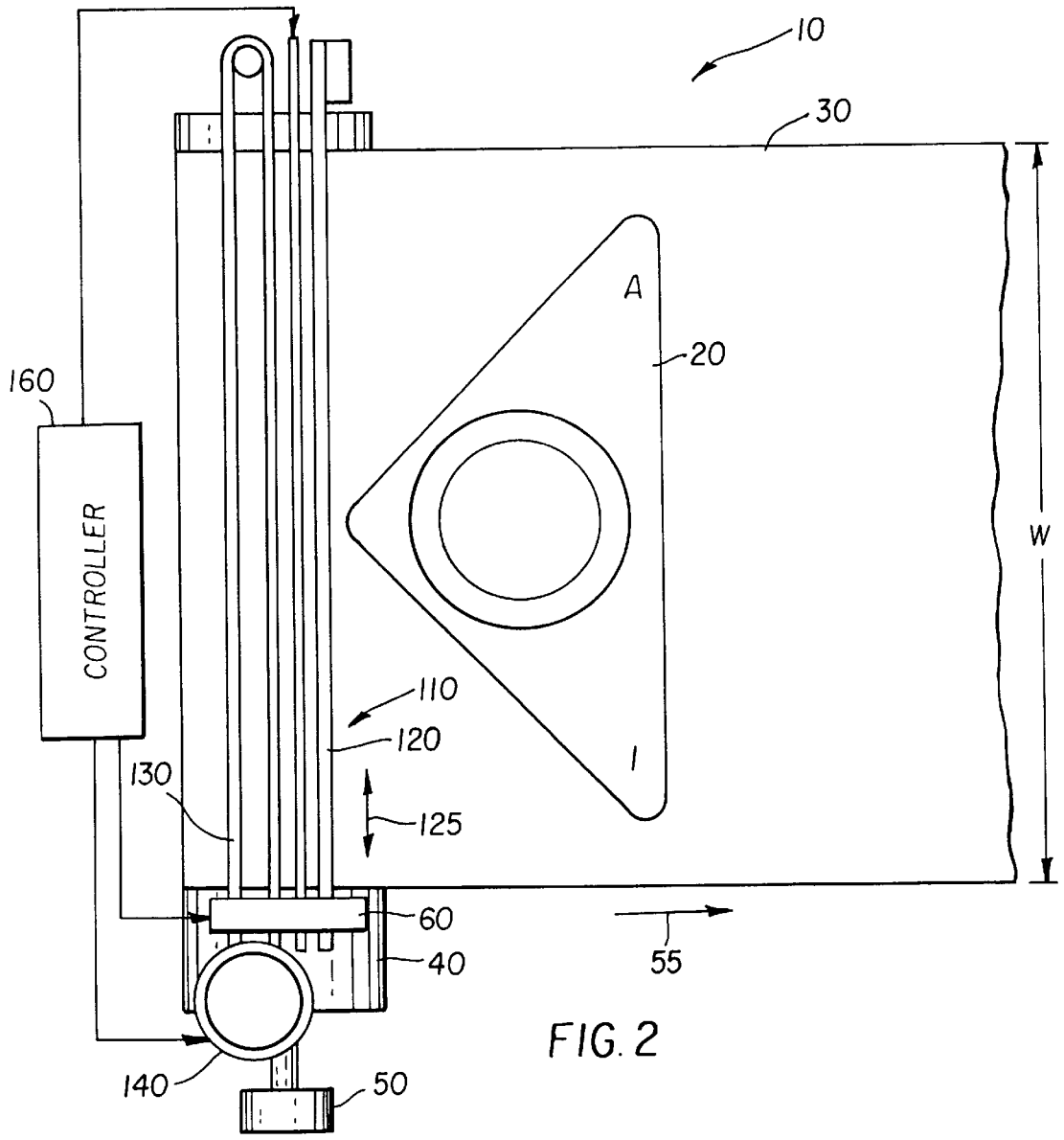
FIG. 2 is a plan view taken along section line 2—2 of FIG. 1.

Therefore, referring to FIGS. 1 and 2, there is shown a first ink jet printer, generally referred to as 10, for printing an image 20 on a receiver 30 having a width "W", which receiver 30 may be a reflective-type receiver (e.g., paper) or a transmissive-type receiver (e.g., transparency). Receiver 30 is supported on a platen roller 40 capable of being rotated by a platen roller motor 50 engaging platen roller 40. Thus, when platen roller motor 50 rotates platen roller 40, receiver 30 will advance in a direction illustrated by a first arrow 55.

Figure 3:
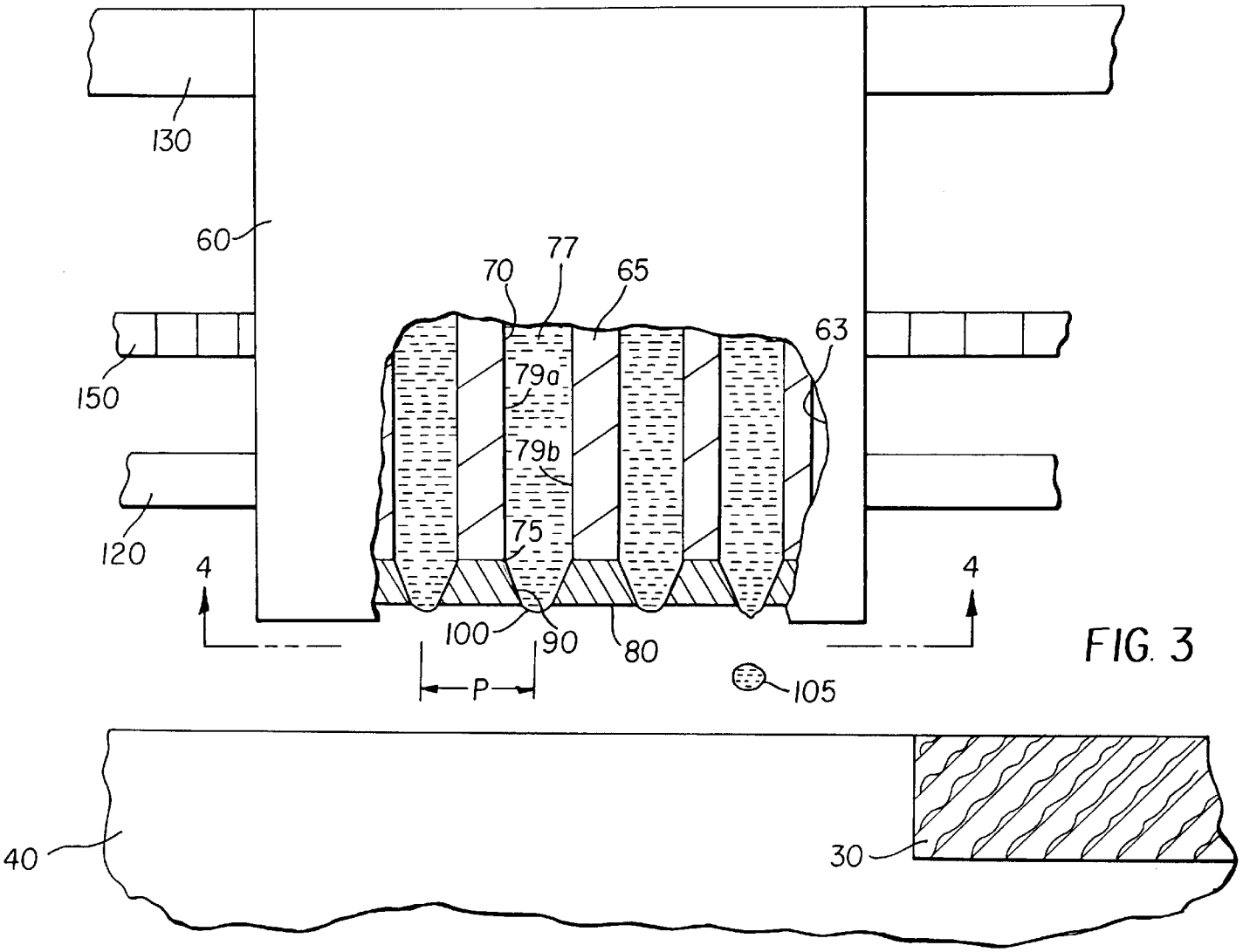
FIG. 3 is a view in partial elevation of a print head body having a nozzle block slidably disposed therein.

As best seen in FIG. 3, printer 10 also comprises a first embodiment print head body 60 disposed adjacent to platen roller 40. Slidably received in a cavity 63 formed in print head body 60 is a nozzle block 65 having a plurality of aligned printing elements, such as aligned ink channels 70 of number "N" (only four of which are shown). Each channel 70 terminates in a channel outlet 75, opposite receiver 30. In addition, each channel 70, which is adapted to hold an ink body 77 therein, is defined by a pair of oppositely disposed parallel side walls 79*a* and 79*b*. Attached, such as by a suitable adhesive, to nozzle block 65 is a cover plate 80 having a plurality of aligned side-by-side nozzle orifices 90 formed therethrough colinearly aligned with respective ones of channel outlets 75. Adjacent ones of orifices 90 have a center-to-center constant predetermined pitch "P" (as shown). When ink body 77 fills channel 70, a meniscus 100 forms at orifice 90 and is held at orifice 90 by surface tension of meniscus 100. Of course, in order to print image 20 on receiver 30, an ink droplet 105 must be released from orifice 90 in direction of receiver 20, so that droplet 105 is intercepted by receiver 20. To achieve this result, nozzle block 65 may be a "piezoelectric ink jet" nozzle block formed of a piezoelectric material, such as lead zirconium titanate (PZT). Such a piezoelectric material is mechanically responsive to electrical stimuli so that side walls 79*a*/*b* simultaneously inwardly deform when electrically stimulated. When side walls 79*a*/*b* simultaneously inwardly deform, volume of channel 70 decreases to squeeze ink droplet 105 from channel 70. Alternatively, nozzle block 65 may be a "continuous ink jet" nozzle block, wherein ejection of ink droplet 105 is caused by a pressure induced in ink body 77.

Returning to FIGS. 1 and 2, a transport mechanism, generally referred to as 110, is connected to print head body 60 for reciprocating print head body 60 between a first position 115*a* thereof and a second position 115*b* (shown in phantom). In this regard, print head body 60 slidably engages an elongate guide rail 120, which guides print head body 60 parallel to platen roller 40 while print head body 60 is reciprocated across width W in a direction as shown by a double headed second arrow 125. In addition to guide rail 120, transport mechanism 110 also comprises a drive belt 130 attached to print head body 60 for reciprocating print head body 60 between first position 115*a* and second position 115*b*, in the manner described presently. In this regard, a reversible drive belt motor 140 engages belt 130, such that belt 130 reciprocates in order that print head body 60 reciprocates along width W of receiver 30. Moreover, an encoder strip 150 coupled to print head body 60 monitors position of print head body 60 as print head body 60 reciprocates between first position 115*a* and second position 115*b*. In addition, a controller 160 is connected to platen roller motor 50, drive belt motor 140, encoder strip 150 and print head body 60 for controlling operation thereof, so that image 20 suitably forms on receiver 30. Such a controller may be a Model CompuMotor controller available from Parker Hannifin, Incorporated located in Rohnert Park, Calif.

Figure 4:
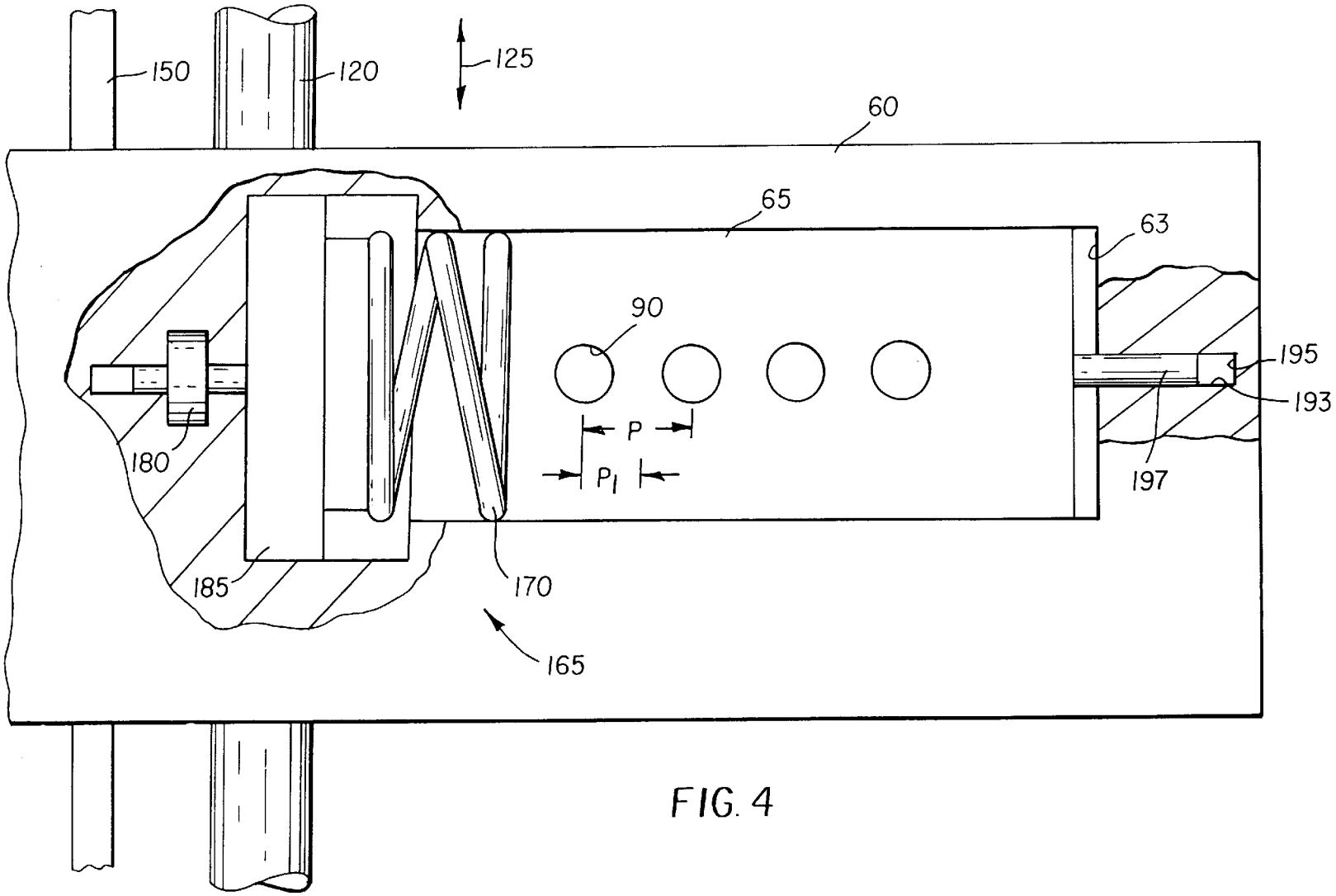
FIG. 4 is a view taken along section line 4—4 of FIG. 3 showing a bottom view of the nozzle block and a first embodiment displacement mechanism connected to the nozzle block.

Referring now to FIG. 4, there is shown a first embodiment displacement mechanism, such as a spring-loaded actuator generally referred to as 165. Spring-loaded actuator 165 comprises an elastic spring 170 coupled to nozzle block 65 for slidably biasing nozzle block 65 in cavity 63 along a predetermined displacement distance "$P_1$" less than pitch P, for reasons described hereinbelow. Of course, displacement of nozzle block 65 is in a direction perpendicular to direction of reciprocating motion of print head body 60. It will be appreciated that predetermined displacement distance $P_1$ is given by the following functional relationship:

$$P_1 = n\left(\frac{P}{k}\right),$$

where, $P_1 \equiv$ predetermined displacement distance (e.g., inches);

$n \equiv$ an integer (dimensionless);

$P \equiv$ nozzle pitch (e.g., inches); and $k \equiv$ increase in printing resolution (dimensionless)

Thus, it may be appreciated that displacement distance P1 is equal to an integer multiple (i.e., "n") of fractional pitch units (i.e., "P/k"). As stated hereinabove, print head body 60 is capable of reciprocating translational motion. Thus, print head obtains a zero velocity at an extreme point (e.g., second position 115*b*) of the reciprocation. According to the preferred embodiment of the invention, spring actuator 165 moves nozzle block 65 while print head body 60 has zero velocity. Moreover, after displacement has occurred, print head body 60 is again translated to print a displaced row of dots. This has the effect of increasing printed resolution by the factor k over the physical resolution of the array of channels 70. Printed resolution may be increased by any desired factor k, consistent with accuracy of movement of the displacement mechanism. Of course, printed dot size is adjusted accordingly. Of course, there are N channels, as previously mentioned. Thus, unlike prior art devices, there is no required relationship between factor k and number of nozzles N. However, the k+1 displacement can be different in size compared to the first k displacements; thus, relative printhead-receiver motion need not be uniform. The k+1 motion may be carried-out by print head 60, in which case there is no need for receiver motion during printing. On the other hand, the k+1 motion may be provided by motion of receiver 30. Moreover, to print a single image 20 on receiver 30, the k+1 motion is equal to Np. To print a plurality of images 20, the k+1 motion is equal Np+ΔI, where ΔI is spacing between individual ones of the plurality of images 20.

Referring again to FIG. 4, a motor 180 is preferably connected to spring 170, such as by means of a movable base 185, for exerting a force on spring 170, so that spring 170 exerts a force on nozzle block 65. Of course, motor 180 can include a suitable encoder capable of monitoring the amount of motor rotation. Nozzle block 65 slidably advances in cavity 63 in response to the force exerted on nozzle block 65 by spring 170. A blind bore 193 having a closed end 195 is formed in print head body 60, which blind bore 193 is sized to slidably receive an elongate extension 197 of nozzle block 65. Motor 180 is operated to exert a force on spring 170 to displace nozzle block 65 a predetermined distance $P_1$.

Figure 5:
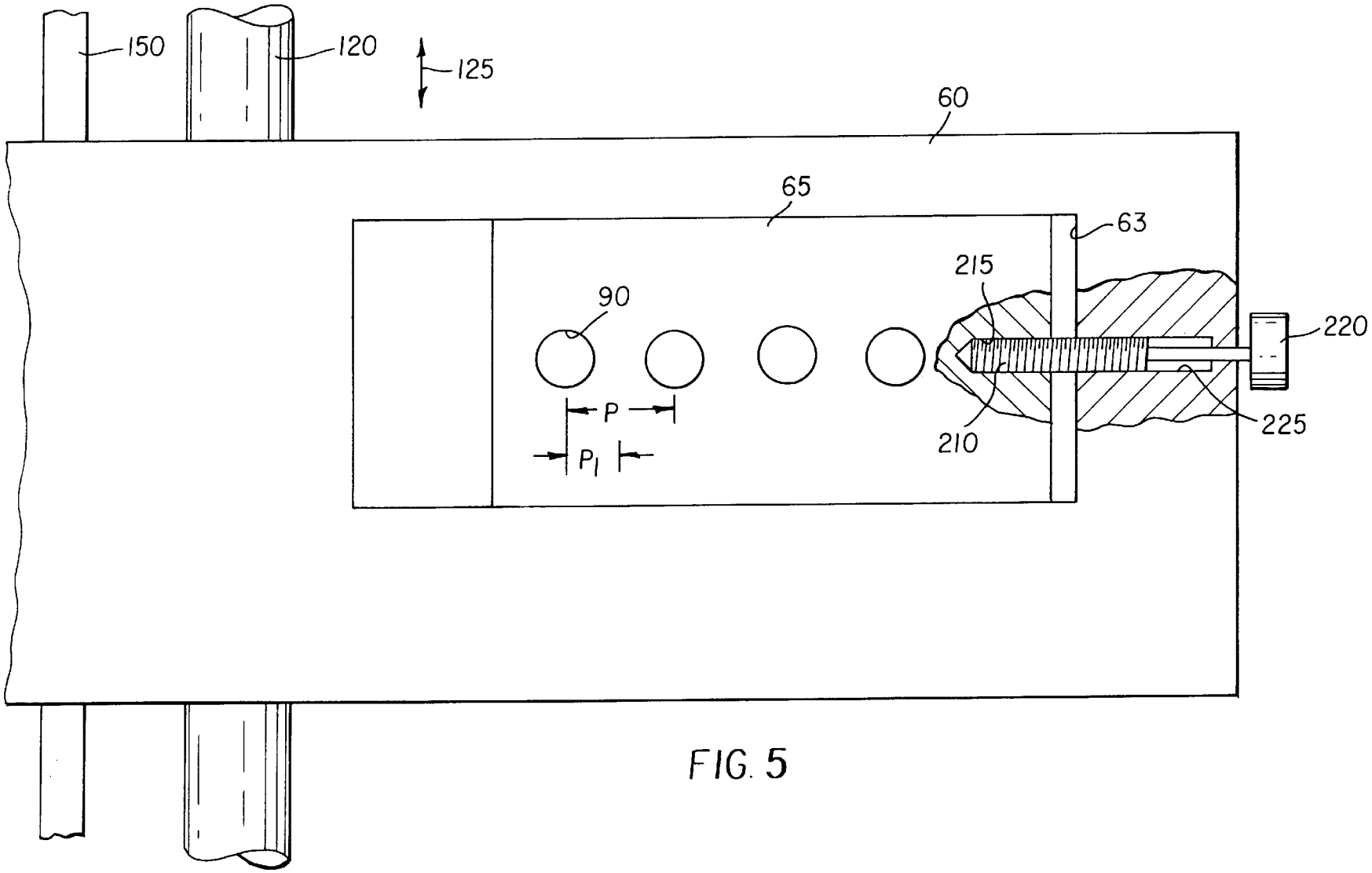
FIG. 5 is a bottom view of the nozzle block and a second embodiment displacement mechanism connected to the nozzle block.

Referring to FIG. 5, there is shown a second embodiment displacement mechanism, such as a screw-driven actuator generally referred to as 200. Screw-driven actuator 200 comprises a lead screw 210 having external threads thereon, which lead screw 210 threadably engages an internally threaded bore 215 formed in nozzle block 65. A reversible motor 200 is preferably connected to lead screw 210 for rotating lead screw 210, so that lead screw 210 slidably advances nozzle block 65 in cavity 63 while lead screw 210 rotates. A counter-sink bore 225 may be formed in print head body 60, which counter-sink bore 225 is sized to receive lead-screw 210. Thus, threaded engagement of the external threads of lead screw 210 with the internal threads of counter-sink bore 225 precisely moves nozzle block 65 in cavity 63 along predetermined distance "$P_1$". Moreover, advancement of nozzle block 65 in cavity 63 is a function of the amount of rotation of lead-screw, pitch of the external threads of lead screw 210 and pitch of the internal threads of counter-sink bore 225. Thus, a person or ordinary skill in the art, without undue experimentation, may predetermine amount of rotation of lead-screw, pitch of the external threads of lead screw 210 and pitch of internal threads of counter-sink bore 225 that will precisely move nozzle block 65 the predetermined distance $P_1$. After nozzle block 65 advances in cavity 63 the predetermined distance $P_1$, nozzle block 65 can thereafter be caused to retreat in cavity 63 the same distance $P_1$ by rotating lead screw 210 in a direction opposite its initial rotation.

Figure 6:
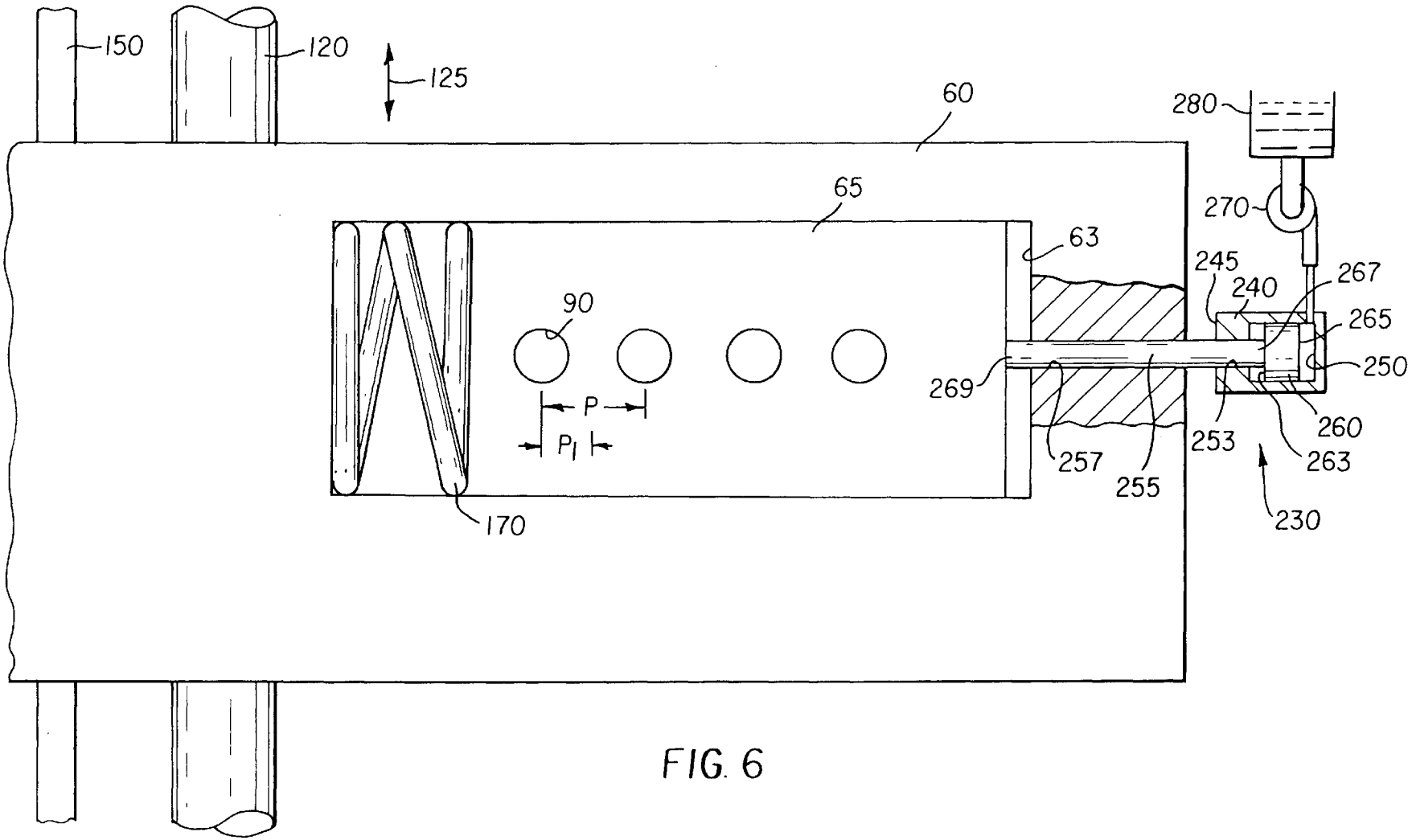
FIG. 6 is a bottom view of the nozzle block and a third embodiment displacement mechanism connected to the nozzle block.

Referring to FIG. 6, there is shown a third embodiment displacement mechanism, such as a hydraulic actuator generally referred to as 230. Hydraulic actuator 230 comprises an enclosure 240 having a surface 245 thereon and defining a chamber 250 therein. A bore 253 extends from chamber 250 to surface 245 and is sized to slidably receive an elongate piston rod 255 for reasons described presently. Moreover, a movable piston 260 is slidably disposed in chamber 240, which piston 260 has an anterior face 263 and a posterior face 265. Piston rod 255 has a first end portion 267 thereof connected to anterior face 263 and a second end portion 269 thereof attached to nozzle block 65. A reversible-flow pump 270 is in fluid communication with chamber 250 for pumping a hydraulic liquid (e.g., water, oil, or the like) from a liquid reservoir 280 and into chamber 250. As pump 270 pumps the liquid into chamber 250, posterior face 265 of piston 260 is pressurized and will slidably move in chamber 250 in a direction toward nozzle block 65. As piston 260 moves, piston rod 255 will slidably move in bore 257 to a like extent because piston rod 255 is connected to piston 260. Of course, as piston rod 255 moves, nozzle block 65 will slidably move in cavity 63 to a like extent because piston rod 255 is also connected to nozzle block 65. However, amount of pressurization of posterior face 265 is controlled so that nozzle block 65 advances only the predetermined distance $P_1$. Once nozzle block 65 moves the predetermined distance $P_1$, pump 270 is cause to cease operation. Elastic spring 170, which has a predetermined spring constant, is also provided in this embodiment of the displacement mechanism. That is, elastic spring 170, which is coupled to nozzle block 65, exerts a force that slidably biases nozzle block 65 in cavity 63, such that nozzle block 65 returns to its initial starting point after pump 270 ceases operation. This is so because spring 170 is selected such that force of spring 170 exerted on nozzle block 65 is greater than pressure on posterior face 265 when pump 270 ceases operation and also due to pump 270 allowing reverse flow of liquid therethrough. Advancement of nozzle block 65 in cavity 63 is limited by amount of pressurization of posterior face 265 and the spring constant of spring 170. Thus, a person of ordinary skill in the art may, without undue experimentation, predetermine the appropriate amount of pressurization of posterior face 265 and the spring constant so that nozzle block 65 moves the predetermined distance $P_1$.

Figure 7:
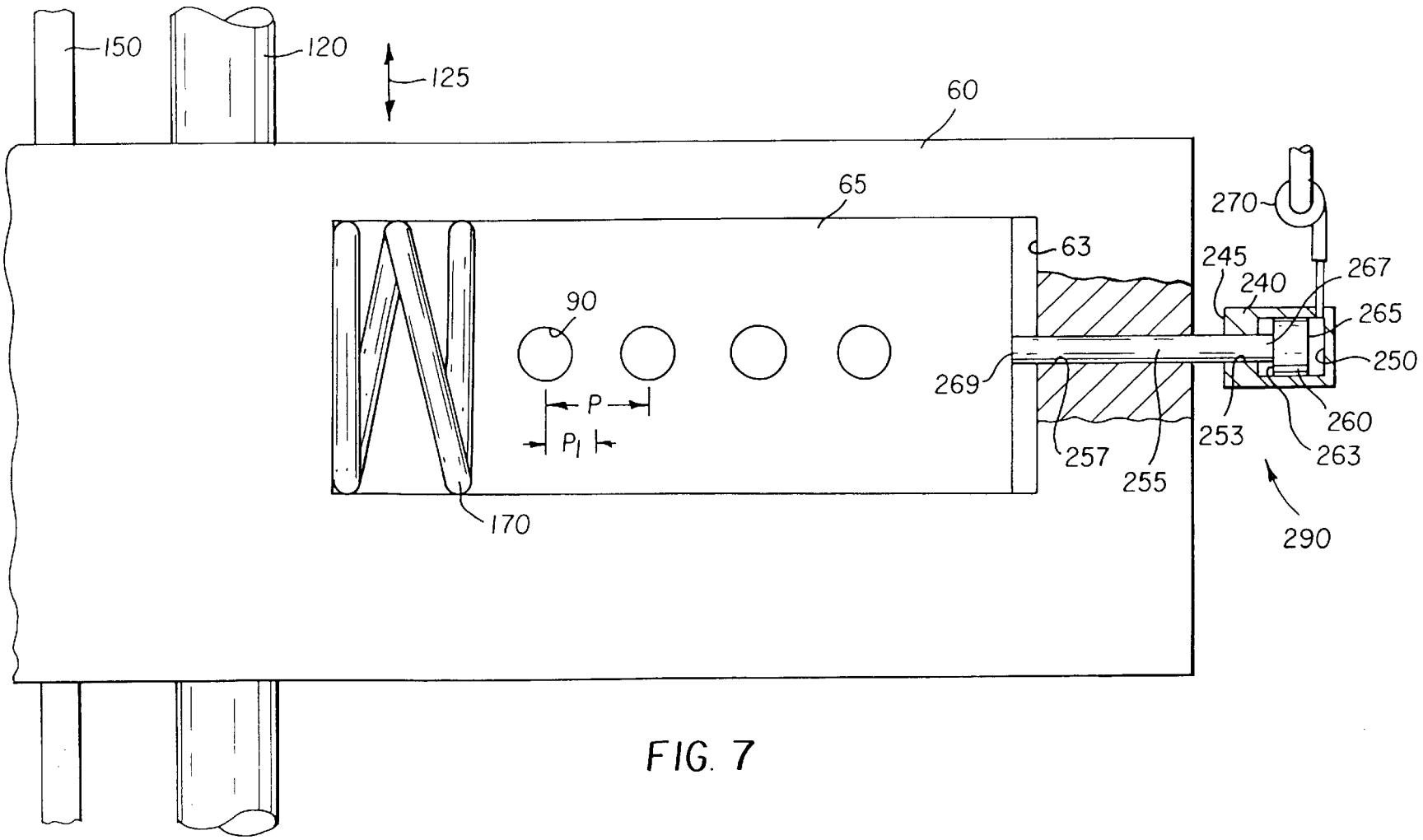
FIG. 7 is a bottom view of the nozzle block and a fourth embodiment displacement mechanism connected to the nozzle block.

Referring to FIG. 7, there is shown a fourth embodiment displacement mechanism, such as a pneumatic actuator generally referred to as 290. This fourth embodiment of the displacement mechanism is substantially identical to the third embodiment of the displacement mechanism, except that liquid reservoir 280 is absent and pump 270 pumps a gas (e.g., air) into chamber 250 rather than a liquid to achieve similar results.

Figure 8:
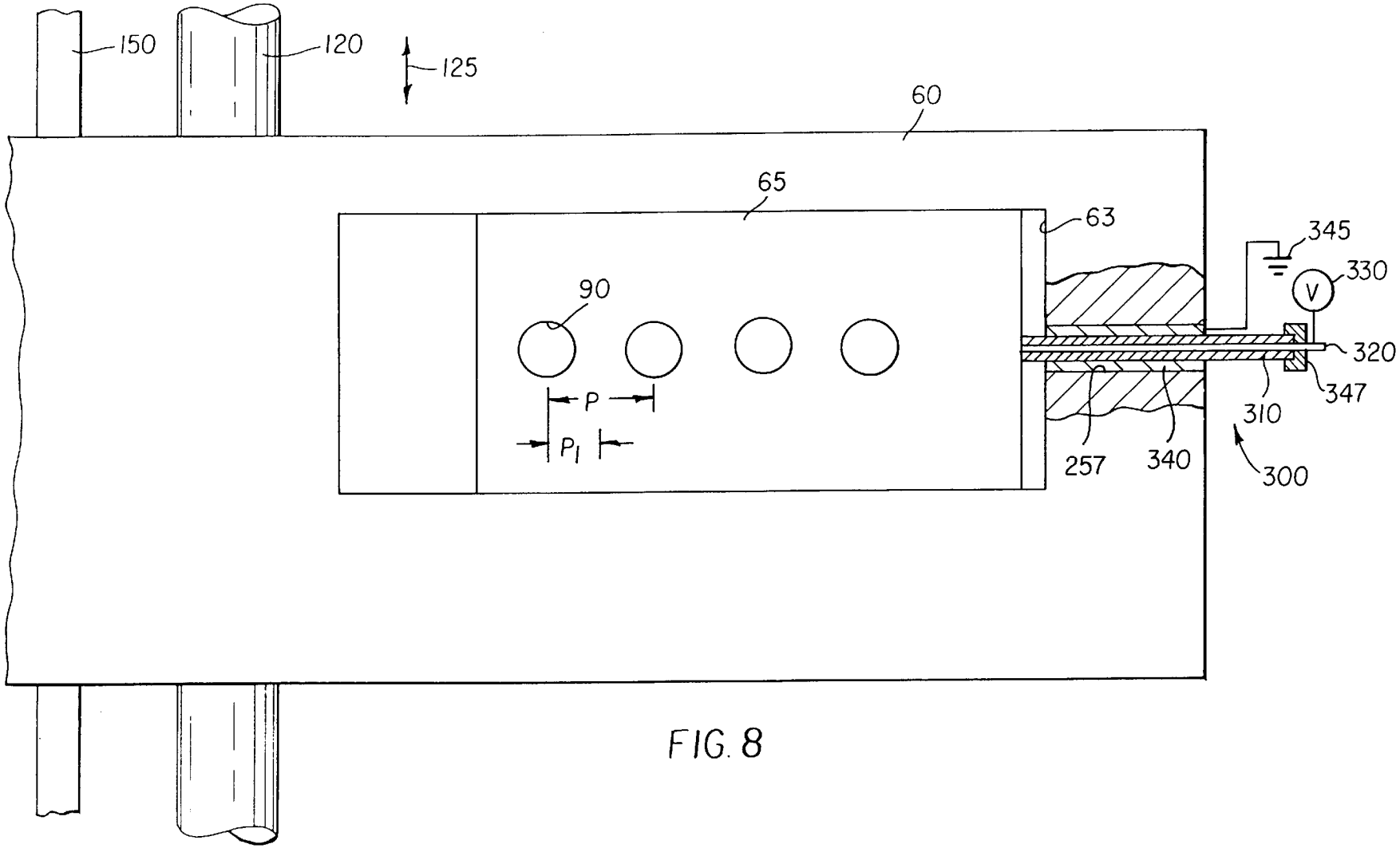
FIG. 8 is a bottom view of the nozzle block and a fifth embodiment displacement mechanism connected to the nozzle block.

Referring to FIG. 8, there is shown a fifth embodiment displacement mechanism, such as a piezoelectric actuator generally referred to as 300. Piezoelectric actuator 300 comprises a shaft 310 slidably disposed in bore 257. Shaft 310 is made of piezoelectric material, such as lead zirconium titanate (PZT), capable of deforming in a preferred direction in response to electrical stimulus applied thereto. In this regard, the piezoelectric material of shaft 310 is selected such that when the electrical stimulus is applied thereto, it will elongate in direction of nozzle block 65 and become narrower. In order to apply electrical stimulus to shaft 310, a first electrode 320 is connected to shaft 310, which first electrode 320 is also connected to a voltage source 330 for applying voltage to shaft 310. In addition, a second electrode 340 is also connected to shaft 310, which second electrode 340 is connected to ground potential, as at point 345. By way of example only, and not by way of limitation, first electrode 320 may extend centrally in shaft 310 and second electrode 340 may be disposed in bore 257 and surround shaft 310. As voltage is applied to first electrode 320, an electric field is established between first electrode 320 and second electrode 340 and thus this electric field is established in shaft 310 so that shaft 310 elongates. Shaft 310 will preferentially slidably elongate in bore 257 toward nozzle block 65 because movement of shaft 310 is constrained at an end thereof farthest away from nozzle block 65 by presence of an immovable stop 347 rigidly connected to shaft 310. The other end of shaft 310 is free to move because this other end of shaft 310 is connected to nozzle block 65 and nozzle block 65 is slidably movable in cavity 63. When the voltage ceases, shaft 310 becomes shorter for returning nozzle block 65 to its initial position. Advancement of nozzle block 65 in cavity 63 is limited by amount of voltage applied to shaft 310. Thus, a person of ordinary skill in the art may, without undue experimentation, predetermine the appropriate amount of voltage so that nozzle block 65 moves the predetermined distance $P_1$. A suitable piezoelectric actuator is available from Polytec PI, Incorporated located in Auburn, Mass.

Figure 9:
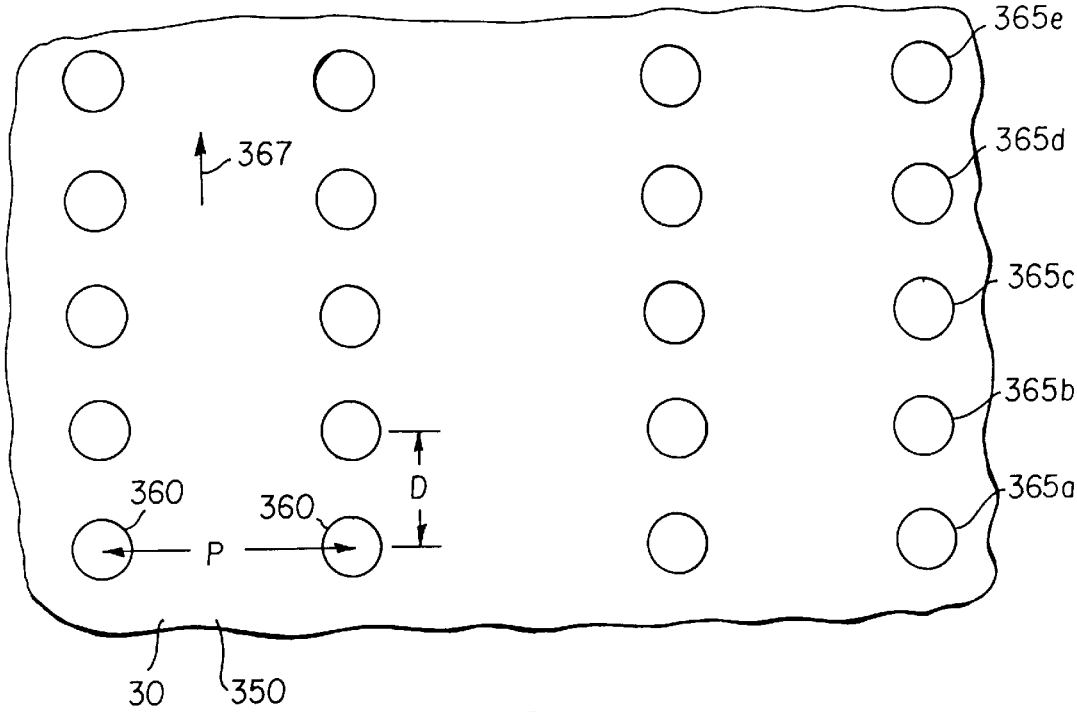
FIG. 9 is an enlarged fragmentation view of an area of the image, wherein a plurality of marks formed by the nozzle block while in a first position thereof define a first spatial resolution of the marks.

Turning now to FIG. 9, an area 350 of image 20 comprises a plurality of marks 360 formed into a plurality of rows 365*a/b/c/d/e* by ink droplets 105 ejected onto receiver 30 by ink ejection channels 70. Adjacent ones of marks 360 have predetermined pitch P because channels 70, from which droplets 105 have been ejected, have predetermined pitch P. For purposes of illustration, travel of print head body 60 is in direction of a third arrow 367 and droplets 105 are ejected by print head body 60 at a constant spacing "D" to form rows 365*a/b/c/d/e*. As may be understood with reference to FIG. 9, this initial position of nozzle block 65, and channels 70 associated therewith, define a first spatial resolution of marks 360. However, it is important to achieve a second spatial resolution greater than the first spatial resolution of marks 360 in order to increase spatial resolution of image 20. This is important in order to increase aesthetic enjoyment of image 20 by increasing fine detail of image 20.

Figure 10:
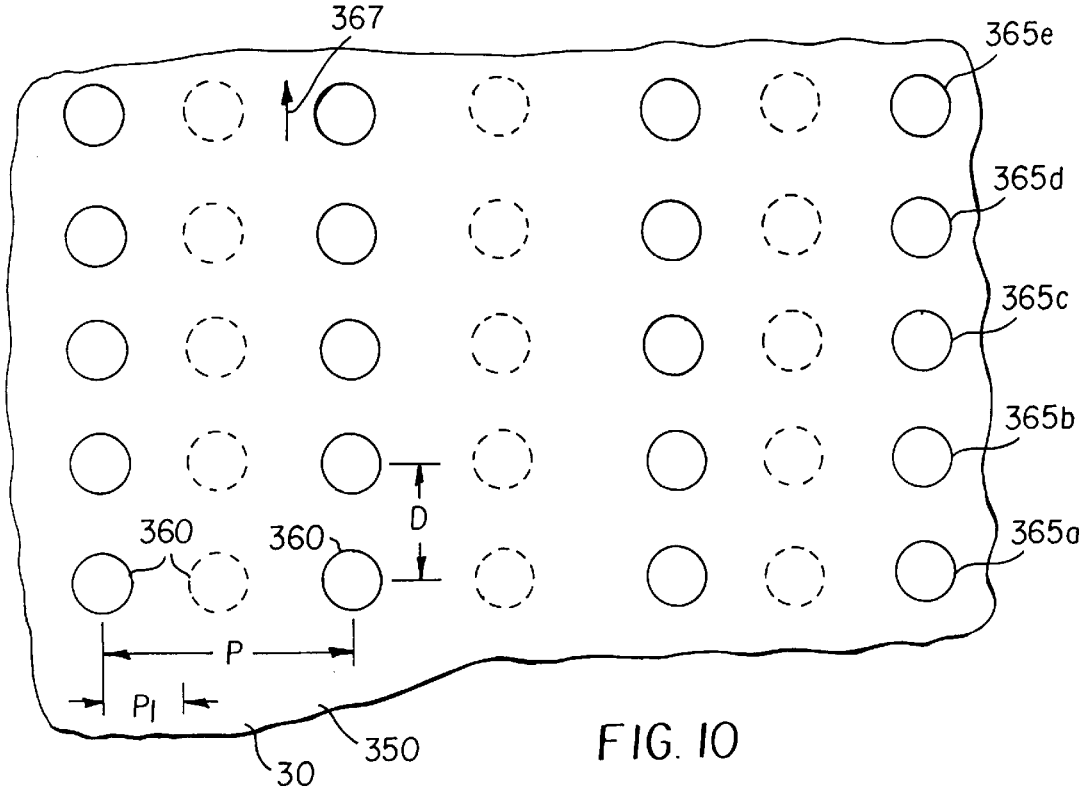
FIG. 10 is an enlarged fragmentation view of the area of the image, wherein a plurality of the marks formed by the nozzle block while in a second position thereof define a second spatial resolution of the marks greater than the first spatial resolution.

Therefore, referring to FIG. 10, nozzle block 65, and thus ink ejection channels 70, are slidably moved in cavity 63 the predetermined distance $P_1$ less than predetermined pitch P, as previously described. This is done to increase spatial resolution of image 20. Movement of nozzle block 65 is obtained by use of any of the previously mentioned embodiments of the displacement mechanism. That is, channels 70 are enabled so that droplets 105 are ejected by channels 70 when nozzle block 65 resides in its initial position. The marks 360 formed when nozzle block 65 is in its initial position define a first spatial resolution of the marks 360.

Thereafter, nozzle block 65 is moved predetermined distance $P_1$ and again enabled to eject additional droplets 105 to form additional marks 360 (shown in phantom). Thus, when channels 70 form additional marks 360 at predetermined distance $P_1$, all marks 360 will now define a second spatial resolution greater than the first spatial resolution. It is in this manner that spatial resolution of image 20 is increased.

Figure 11:
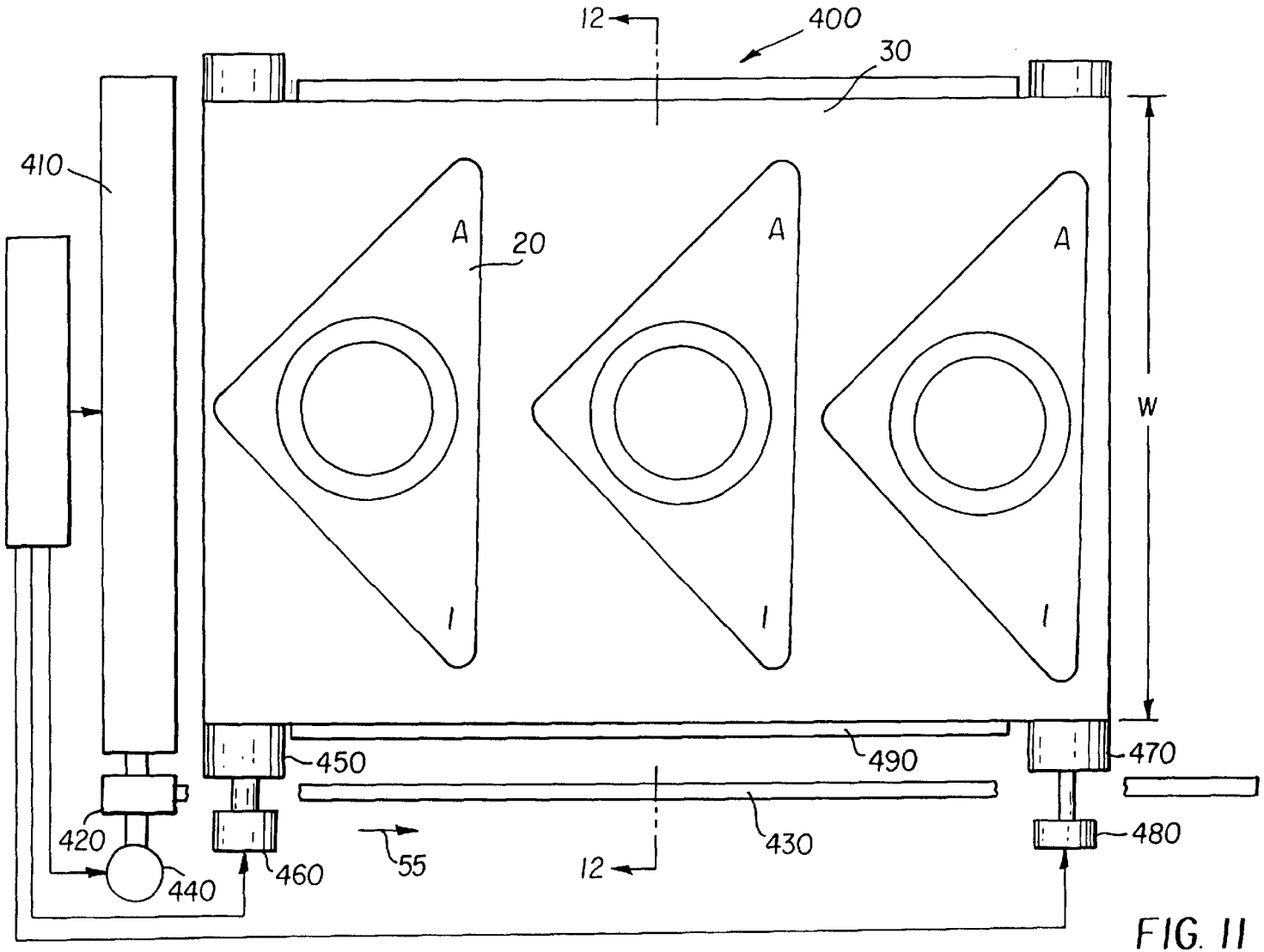
FIG. 11 is a plan view of a second ink jet printer belonging to the present invention for printing the image on the receiver.
Figure 12:
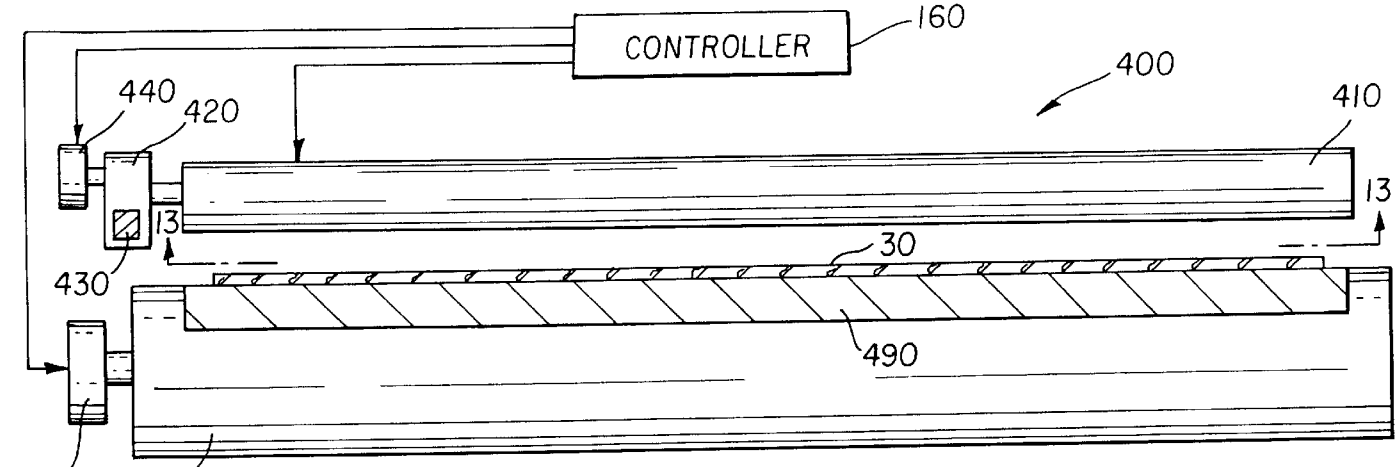
FIG. 12 is a view taken along section line 12—12 of FIG. 11.
Figure 13:
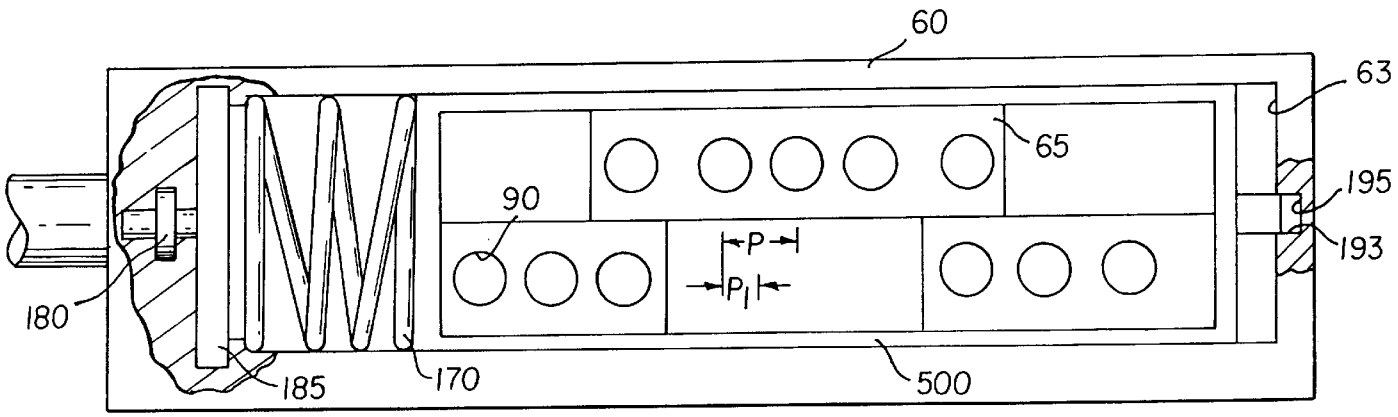
FIG. 13 is a view taken along section line 13—13 of FIG. 12 showing a bottom view of a plurality of adjacent interleaved nozzle blocks and the first embodiment displacement mechanism connected to the nozzle blocks.
Figure 14:
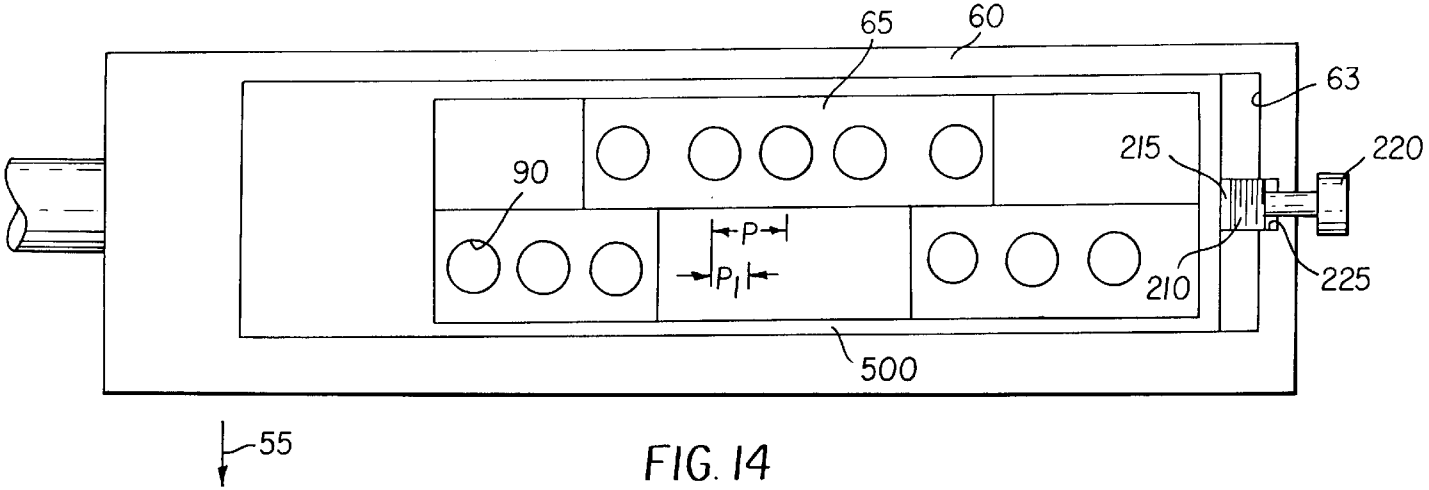
FIG. 14 is a bottom view of the nozzle blocks and the second embodiment displacement mechanism connected to the nozzle blocks.
Figure 15:
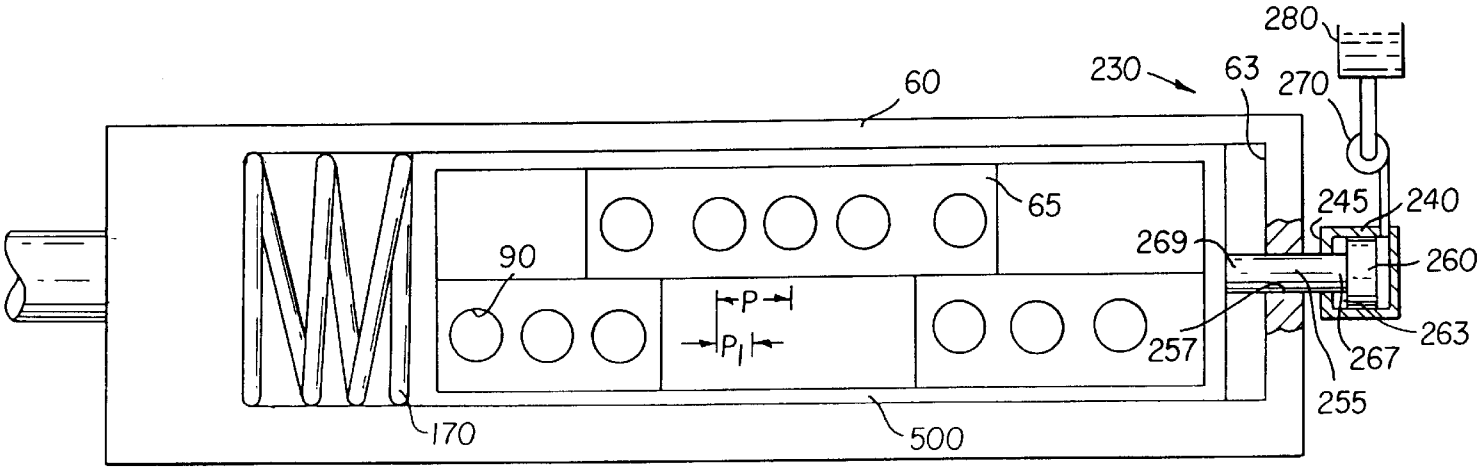
FIG. 15 is a bottom view of the nozzle blocks and the third embodiment displacement mechanism connected to the nozzle blocks.
Figure 16:
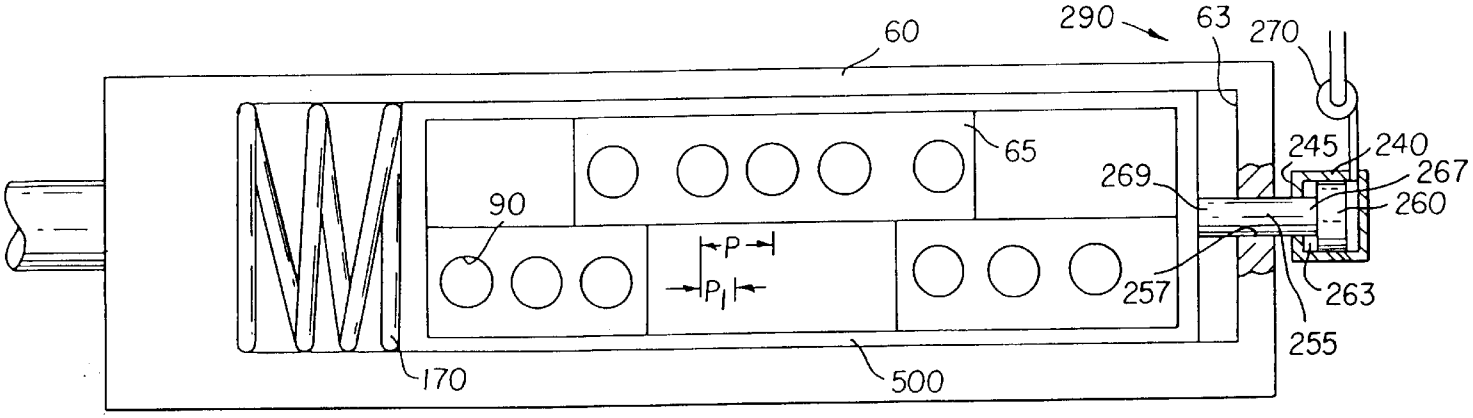
FIG. 16 is a bottom view of the nozzle blocks and the fourth embodiment displacement mechanism connected to the nozzle blocks.
Figure 17:
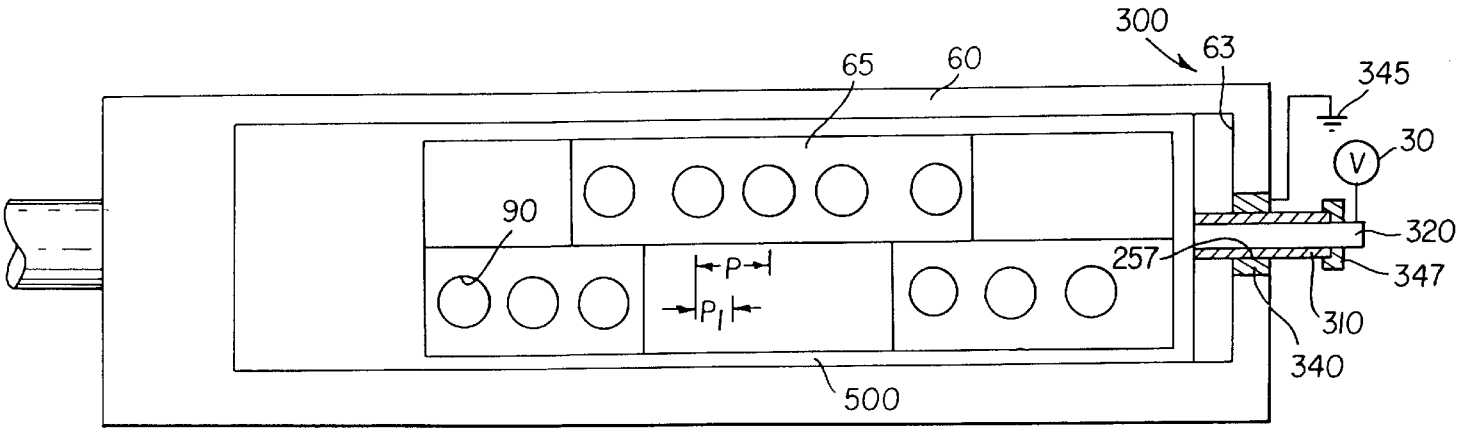
FIG. 17 is a bottom view of the nozzle blocks and the fifth embodiment displacement mechanism connected to the nozzle blocks.

Referring now to FIGS. 11 and 12, there is shown a second ink jet printer, generally referred to as 400, for printing image 20 on receiver 30. Second printer 400 is a so-called "page-width" printer capable of printing across width W of receiver 30 without reciprocating across width W. That is, printer 400 comprises a second embodiment print head body 410 of length substantially equal to width W. Connected to print head body 410 is a carriage 420 adapted to carry print head body 410 in direction of first arrow 55. In this regard, carriage 420 slidably engages an elongate slide member 430 extending parallel to length of receiver 30 in direction of first arrow 55. A first motor 440 is connected to carriage 420 for operating carriage 420 so that carriage 420 slides along slide member 430 in direction of first arrow 55. As carriage 420 slides along slide member 430 in direction of first arrow 55, print head body 410 also travels in direction of first arrow 55 because print head body 410 is connected to carriage 420. In this manner, print head body 410 is capable of printing a plurality of images 20 (as shown) in a single printing pass along a length of receiver 30. In addition, a first feed roller 450 engages receiver 30 for feeding receiver 30 in direction of first arrow 55 after images 20 have been printed. In this regard, a second motor 460 engages first feed roller 450 for rotating first feed roller 450, so that receiver 30 feeds in direction of first arrow 55. Further, a second feed roller 470, spaced-apart from first feed roller 450, may also engage receiver 30 for feeding receiver 30 in direction of first arrow 55. In this case, third motor 480, synchronized with second motor 460, engages second feed roller 470 for rotating second feed roller 470, so that receiver 30 feeds in direction of first arrow 55. Interposed between first feed roller 450 and second feed roller 470 is a support member, such as a stationary platen 490, for supporting receiver 30 thereon as receiver feeds from first feed roller 450 to second feed roller 470. Of course, previously mentioned controller 160 is connected to print head body 410, first motor 440, second motor 460 and third motor 480 for controlling operation thereof in order to suitably form image 20 on receiver 30.

Referring to FIGS. 13, 14, 15, 16 and 17, second embodiment print head body 410 includes a plurality of nozzle blocks 65 off-set one from another, so that nozzle blocks 65 obtain an interleaved configuration (as shown). More specifically, end portions of individual ones of adjacent nozzle blocks 65 overlap, so that orifices 90 laying in such overlapping regions are capable of addressing the same location on receiver 30. Print head body 410 is capable of translational motion in direction of first arrow 55 and housing 500 is capable of displacement by any desired distance perpendicular to direction of motion of print heady body 410. For convenience, the plurality of nozzle blocks 65 may be housed in a housing 500 capable of being moved in the manner described hereinabove in connection with first embodiment print head body 60.

It may be appreciated from the description hereinabove that an advantage of the present invention is that image 20 obtains increased spatial resolution. This is so because additional marks 360 are formed due to movement of nozzle block 65, which additional marks are intermediate marks that are formed when nozzle block 65 is in its initial position relative to print head body 60.

It may be appreciated from the description hereinabove that another advantage of the present invention is that fault tolerance of the printer is increased. This is so because the same dot location on receiver 30 can now be addressed by different nozzles 90. That is, the dot location can be addressed while nozzle block 65 is in its initial position relative to print head body 60 and again addressed after nozzle block 65 has moved predetermined distance nP. In this manner, a selected one of nozzles 90 can compensate for an inoperative nozzle 90.

It may be appreciated from the description hereinabove that still another advantage of the present invention is that spatial resolution of the image is increased in a cost-effective manner. This is so because all available nozzles 90 are used for printing (i.e., no nozzles are intentionally disabled). Printer fabrication costs are also reduced because, at least with respect to second printer 400, receiver 30 does not move during printing of a plurality of images 20. This obviates need for complicated electronic circuitry and an expensive transport mechanism to advance receiver 30 the distance D in order to print each row of dots 360 comprising image 20.

While the invention has been described with particular reference to its preferred embodiments, it will be understood by those skilled in the art that various changes may be made and equivalents may be substituted for elements of the preferred embodiments without departing from the invention. In addition, many modifications may be made to adapt a particular situation and material to a teaching of the present invention without departing from the essential teachings of the invention. For example, the displacement mechanism may take any one of several forms, such as an electromagnetic device. In this case, nozzle block 65 is at least in part made of a metal capable of moving under influence of a magnetic field suitably generated by an electromagnet.

Therefore, what is provided is an ink jet printer capable of increasing spatial resolution of a plurality of marks to be printed thereby and method of assembling the printer.

PARTS LIST

P . . . pitch (of nozzles)
$P_1$ . . . predetermined distance that nozzles are to be moved
W . . . width of receiver
10 . . . first printer
20 . . . image
30 . . . receiver
40 . . . platen roller
50 . . . platen roller motor
55 . . . first arrow
60 . . . first embodiment print head body
63 . . . cavity
65 . . . nozzle block
70 . . . ink channels
75 . . . channel outlets
77 . . . ink body
79*a*/*b* . . . pair of side walls
80 . . . cover plate
90 . . . orifices
100 . . . meniscus
110 . . . transport mechanism
115*a* . . . first position of print head body
115*b* . . . second position of print head body
120 . . . guide rail
125 . . . second arrow
130 . . . drive belt

140 . . . drive belt motor
150 . . . encoder strip
160 . . . controller
165 . . . spring-loaded actuator
170 . . . spring
180 . . . motor
185 . . . base
193 . . . blind bore
195 . . . closed end (of blind bore)
197 . . . extension (of nozzle block)
200 . . . screw-driven actuator
210 . . . lead screw
215 . . . threaded bore
220 . . . motor
225 . . . counter-sink bore
230 . . . hydraulic actuator
240 . . . enclosure
245 . . . surface (of enclosure)
250 . . . chamber
253 . . . bore
255 . . . piston rod
257 . . . bore
260 . . . piston
263 . . . exterior face (of piston)
267 . . . first end portion (of piston rod)
269 . . . second end portion (of piston rod)
270 . . . pump
280 . . . liquid reservoir
290 . . . pneumatic actuator
300 . . . piezoelectric actuator
310 . . . shaft
320 . . . first electrode
330 . . . voltage source
340 . . . second electrode
345 . . . point of ground potential
347 . . . stop
350 . . . area (of image)
360 . . . marks
365*a/b/c/d/e* . . . rows
367 . . . third arrow
400 . . . second printer
410 . . . second embodiment print head body
420 . . . carriage
430 . . . slide member
440 . . . first motor
450 . . . first feed roller
460 . . . second motor
470 . . . second feed roller
480 . . . third motor
490 . . . stationary platen
500 . . . housing

What is claimed is:

1. An ink jet printer capable of increasing spatial resolution of a plurality of marks defining an image to be printed on a receiver, comprising:

(a) a print head body;

(b) a nozzle block slidably connected to said print head body, said nozzle block having a plurality of aligned ink ejection nozzles of predetermined pitch for ejecting a plurality of ink droplets onto the receiver to print the marks on the receiver, said nozzle block movable from a first printing position defining a first spatial resolution of the marks to a second printing position along a predetermined distance less that the predetermined pitch, so that the marks to be printed define a second spatial resolution greater than the first spatial resolution in order to increase spatial resolution of the image;

(c) a displacement mechanism connected to said nozzle block for moving said nozzle block along the predetermined distance, said displacement mechanism including:

(i) a spring connected to said nozzle block for biasing said nozzle block along the predetermined distance; and (ii) a motor connected to said spring for elastically moving said spring; and (d) a controller connected to said displacement mechanism for controlling operation of said displacement mechanism.

2. An ink jet printer capable of increasing spatial resolution of a plurality of marks defining an image to be printed on a receiver, comprising:

(a) a print head body;

(b) a nozzle block slidably connected to said print head body, said nozzle block having a plurality of aligned ink ejection nozzles of predetermined pitch for ejecting a plurality of ink droplets onto the receiver to print the marks on the receiver, said nozzle block movable from a first printing position defining a first spatial resolution of the marks to a second printing position along a predetermined distance less that the predetermined pitch, so that the marks to be printed define a second spatial resolution greater than the first spatial resolution in order to increase spatial resolution of the image;

(c) a displacement mechanism connected to said nozzle block for moving said nozzle block along the predetermined distance, said displacement mechanism including:

(i) an enclosure having a surface thereon, said enclosure defining a chamber therein and a bore extending from the chamber to the surface;

(ii) a movable piston disposed in the chamber, said piston having an anterior face and a posterior face;

(iii) a piston rod slidably extending through the bore, said piston rod having a first end portion thereof connected to the anterior face and a second end portion connected to said nozzle block; and (iv) a pump in fluid communication with the chamber for pumping a fluid into the chamber to pressurize the posterior face, so that said piston moves while the posterior face is pressurized, so that said piston rod moves while said piston moves and so that said nozzle block moves along the predetermined distance while said piston rod moves; and (d) a controller connected to said displacement mechanism for controlling operation of said displacement mechanism.

3. The printer of claim 2, further comprising a fluid reservoir connected to said pump for supplying the fluid to said pump.

4. A method of assembling an ink jet printer capable of increasing spatial resolution of a plurality of marks defining an image to be printed on a receiver, comprising the steps of:

(a) slidably connecting a nozzle block to a print head body, the nozzle block having a plurality of aligned ink ejection nozzles of predetermined pitch for ejecting a plurality of ink droplets onto the receiver to print the marks on the receiver, the nozzle block movable from a first printing position defining a first spatial resolution of the marks to a second printing position along a predetermined distance less that the predetermined pitch, so that the marks to be printed define a second spatial resolution greater than the first spatial resolution in order to increase spatial resolution of the image;

(b) connecting a displacement mechanism to the nozzle block for moving the nozzle block along the predetermined distance, the step of connecting a displacement mechanism including the steps of:

(i) connecting a spring to the nozzle block for biasing the nozzle block along the predetermined distance; and (ii) connecting a motor to the spring for elastically moving the spring; and (c) connecting a controller to the displacement mechanism for controlling operation of the displacement mechanism.

5. A method of assembling an ink jet printer capable of increasing spatial resolution of a plurality of marks defining an image to be printed on a receiver, comprising the steps of:

(a) slidably connecting a nozzle block to a print head body, the nozzle block having a plurality of aligned ink ejection nozzles of predetermined pitch for ejecting a plurality of ink droplets onto the receiver to print the marks on the receiver, the nozzle block movable from a first printing position defining a first spatial resolution of the marks to a second printing position along a predetermined distance less that the predetermined pitch, so that the marks to be printed define a second spatial resolution greater than the first spatial resolution in order to increase spatial resolution of the image;

(b) connecting a displacement mechanism to the nozzle block for moving the nozzle block along the predetermined distance, the step of connecting a displacement mechanism including the steps of:

(i) providing an enclosure having a surface thereon, the enclosure defining a chamber therein and a bore extending from the chamber to the surface;

(ii) disposing a movable piston in the chamber, the piston having an anterior face and a posterior face;

(iii) slidably extending a piston rod through the bore, the piston rod having a first end portion thereof connected to the anterior face and a second end portion connected to the nozzle block; and (iv) disposing a pump in fluid communication with the chamber for pumping a fluid into the chamber to pressurize the posterior face, so that the piston moves while the posterior face is pressurized, so that the piston rod moves while the piston moves and so that the nozzle block moves along the predetermined distance while the piston rod moves; and (c) connecting a controller to the displacement mechanism for controlling operation of the displacement mechanism.

6. The method of claim 5, further comprising the step of connecting a fluid reservoir to the pump for supplying the fluid to the pump.

* * * * *